US006981284B2

(12) United States Patent
Durocher

(10) Patent No.: US 6,981,284 B2
(45) Date of Patent: Jan. 3, 2006

(54) HOCKEY HELMET COMPRISING A LATERAL ADJUSTMENT MECHANISM

(75) Inventor: Jacques Durocher, St-Jérôme (CA)

(73) Assignee: BAUER NIKE Hockey Inc., Saint-Jérôme (CA)

( * ) Notice: Subject to any disclaimer, the term of this patent is extended or adjusted under 35 U.S.C. 154(b) by 149 days.

(21) Appl. No.: 10/705,849

(22) Filed: Nov. 13, 2003

(65) Prior Publication Data

US 2005/0034223 A1 Feb. 17, 2005

(30) Foreign Application Priority Data

Aug. 15, 2003 (CA) ..... 2437545

(51) Int. Cl.
*A63B 71/10* (2006.01)

(52) U.S. Cl. ..... 2/425; 2/417

(58) Field of Classification Search ..... 2/414, 2/417, 418, 419, 420, 421, 425
See application file for complete search history.

(56) References Cited

U.S. PATENT DOCUMENTS

| | | | | |
|---|---|---|---|---|
| 3,389,405 A | | 6/1968 | Fattori | |
| 3,787,894 A | | 1/1974 | Goodman, Jr. | |
| 3,866,243 A | * | 2/1975 | Morgan | 2/418 |
| 4,477,929 A | | 10/1984 | Mattsson | |
| 5,014,365 A | * | 5/1991 | Schulz | 2/412 |
| 5,175,889 A | * | 1/1993 | Infusino | 2/413 |
| 5,581,819 A | | 12/1996 | Garneau | |
| 5,638,551 A | | 6/1997 | Lallemand | |
| 5,659,900 A | | 8/1997 | Arney et al. | |
| 5,765,234 A | | 6/1998 | Petzl et al. | |
| 5,815,847 A | * | 10/1998 | Holden, Jr. | 2/418 |
| 5,887,288 A | | 3/1999 | Arney et al. | |
| 5,898,950 A | | 5/1999 | Spyrou et al. | |
| 6,256,798 B1 | * | 7/2001 | Egolf et al. | 2/421 |
| 6,266,827 B1 | | 7/2001 | Lampe et al. | |
| 6,298,497 B1 | | 10/2001 | Chartrand | |
| 6,425,142 B2 | | 7/2002 | Sasaki et al. | |

FOREIGN PATENT DOCUMENTS

| | | |
|---|---|---|
| EP | 0 259 269 A1 | 3/1988 |
| GB | 1 303 612 | 1/1973 |

* cited by examiner

*Primary Examiner*—Rodney M. Lindsey

(57) ABSTRACT

A hockey helmet for receiving a head of a wearer, the head having a crown region, left and right side regions, a back region and an occipital region. The helmet comprises a shell comprising left and right side inner surfaces and left and right side inner pads at least partially covering the inner left and right side surfaces of the shell, the left and right side inner pads facing the respective left and right side regions of the head. The helmet also comprises a wedging member located between one of the left and right side inner pads and one of the respective left and right side inner surfaces. The wedging member is movable between first and second positions, wherein, in the first position, one of the left and right side inner pads apply a first pressure upon the respective left and right side regions of the head, and in the second position, one of the left and right side inner pads apply a second pressure upon the respective left and right side regions of the head. The second pressure is greater than the first pressure.

25 Claims, 7 Drawing Sheets

HOCKEY HELMET COMPRISING A LATERAL ADJUSTMENT MECHANISM

FIELD OF THE INVENTION

The present invention relates to a hockey helmet having a lateral adjustment mechanism for improving the fit of the helmet on the head of the wearer.

BACKGROUND OF THE INVENTION

Hockey helmets that are commercialized today have liners of different thickness that may be affixed to the inner surfaces of the helmet in order to improve the fit between the left and right sides of the head of the wearer and the helmet. There is, however, a need in the industry to develop a more refined technique that allows the wearer to adjust the fit of the helmet, specifically by controlling the pressure the helmet applies upon the left and right sides of the head.

SUMMARY OF THE INVENTION

As embodied and broadly described herein, the present invention provides a hockey helmet for receiving a head of a wearer, the head having a crown region, left and right side regions, a back region and an occipital region. The helmet comprises a shell comprising left and right side inner surfaces; left and right side inner pads at least partially covering the left and right side inner surfaces of the shell, the left and right side inner pads facing the respective left and right side regions of the head; and a wedging member located between one of the left and right side inner pads and one of the respective left and right side inner surfaces. The wedging member is movable between first and second positions. In the first position, one of the left and right side inner pads applies a first pressure upon the respective left and right side regions of the head. In the second position, one of the left and right side inner pads applies a second pressure upon one of the respective left and right side regions of the head. The second pressure is greater than the first pressure.

As embodied and broadly described herein, the present invention also provides a hockey helmet for receiving a head of a wearer, the head having a crown region, left and right side regions, a back region and an occipital region. The helmet comprises a shell comprising left and right side inner surfaces; and left and right side inner pads at least partially covering the left and right side inner surfaces of the shell, the left and right side inner pads facing the respective left and right side regions of the head. The left and right side inner pads are movable between a first position, wherein the left and right side inner pads apply a first pressure upon the respective left and right side regions of the head, to a second position, wherein the left and right side inner pads apply a second pressure upon the respective left and right side regions of the head. The second pressure is greater than the first pressure.

As embodied and broadly described herein, the invention further provides a hockey helmet for receiving a head of a wearer, the head having a crown region, left and right side regions, a back region and an occipital region. The helmet has a shell comprising left and right side inner surfaces and left and right side inner pads at least partially covering the left and right side inner surfaces. A wedging member is located between one of the left and right side inner pads and the respective left and right side inner surface. The wedging member is selectively movable to vary the distance between the one of said left and right side inner pad and the respective left and right side inner surface, to adjust a fit of the helmet on the head of the wearer.

As embodied and broadly described herein, the invention further provides a hockey helmet having a shell and left and right side inner pads at least partially covering the left and right side inner surfaces of the shell. The left and right side inner pads face the respective left and right side regions of the head. The helmet comprises a mechanical actuation device coupled to one of the left and right side inner pads, the mechanical actuation device being operable by the wearer from outside the helmet to cause displacement of the one of said left and right side inner pads for adjusting the fit of the helmet on the head of the wearer.

BRIEF DESCRIPTION OF THE DRAWINGS

A detailed description of the embodiments of the present invention is provided herein below, by way of example only, with reference to the accompanying drawings, in which.

Figure 1:
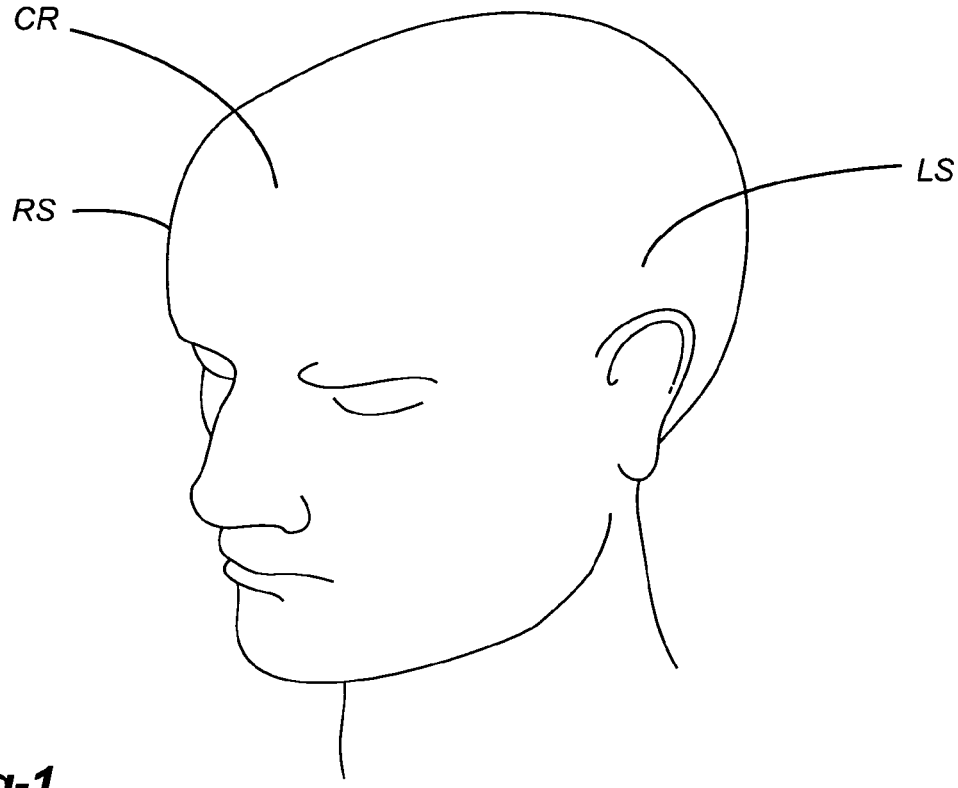
FIG. 1 is a perspective view of a head of a wearer.

In the drawings, embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE EMBODIMENTS OF THE INVENTION

Figure 2:
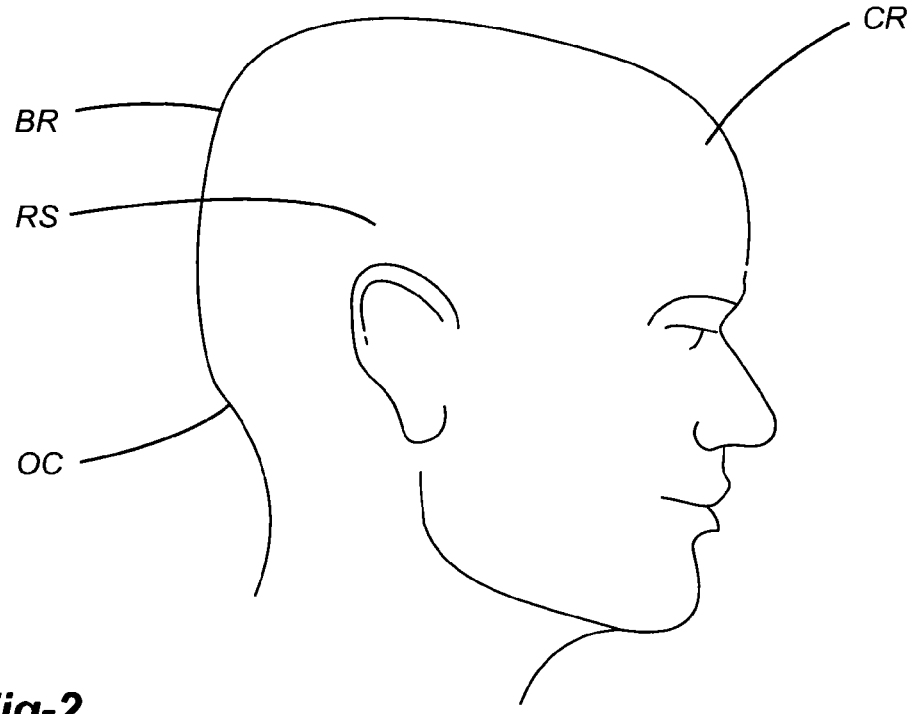
FIG. 2 is a right side elevational view of the head of the wearer of FIG. 1.
Figure 3:
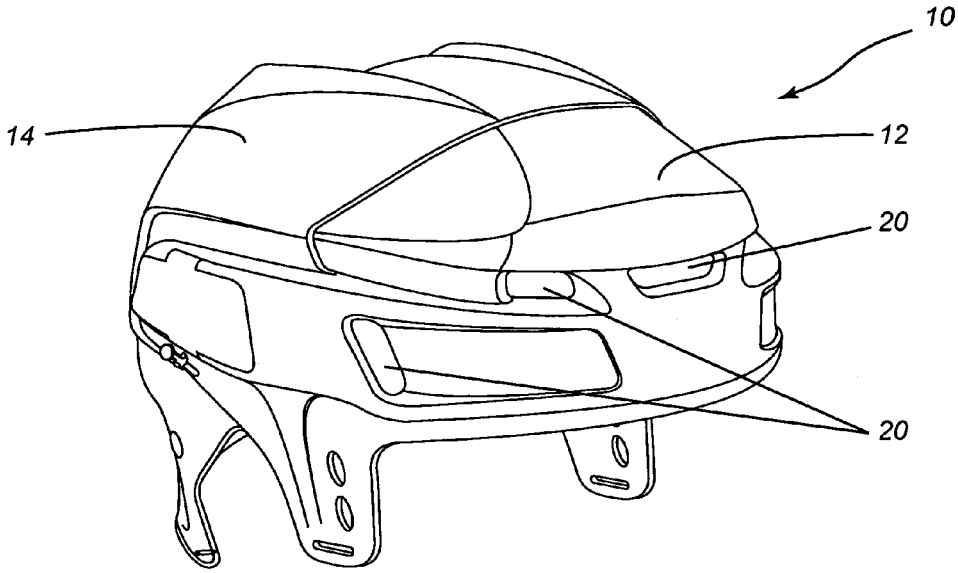
FIG. 3 is a perspective view of a hockey helmet constructed in accordance with an embodiment of the invention.
Figure 4:
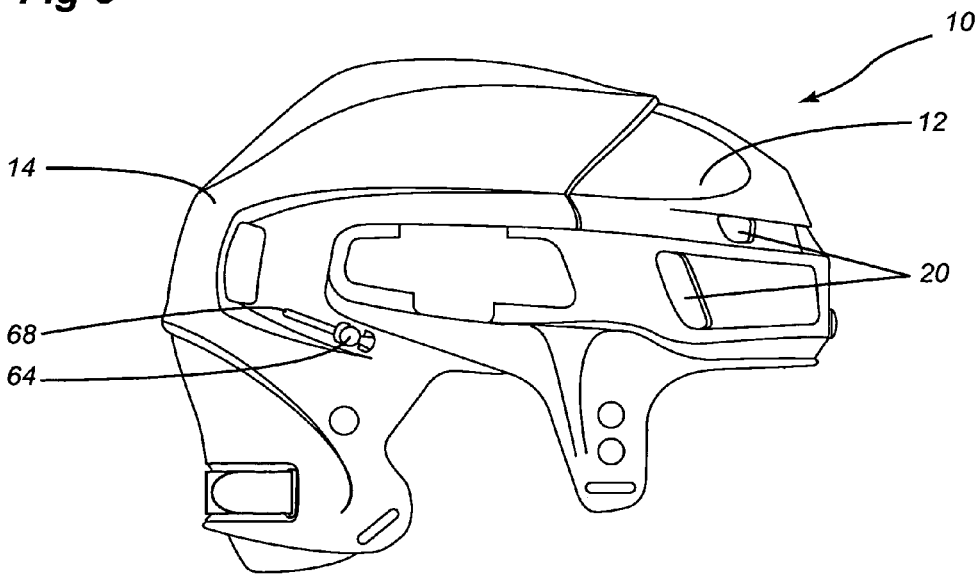
FIG. 4 is a right side elevational view of the hockey helmet of FIG. 3.
Figure 5:
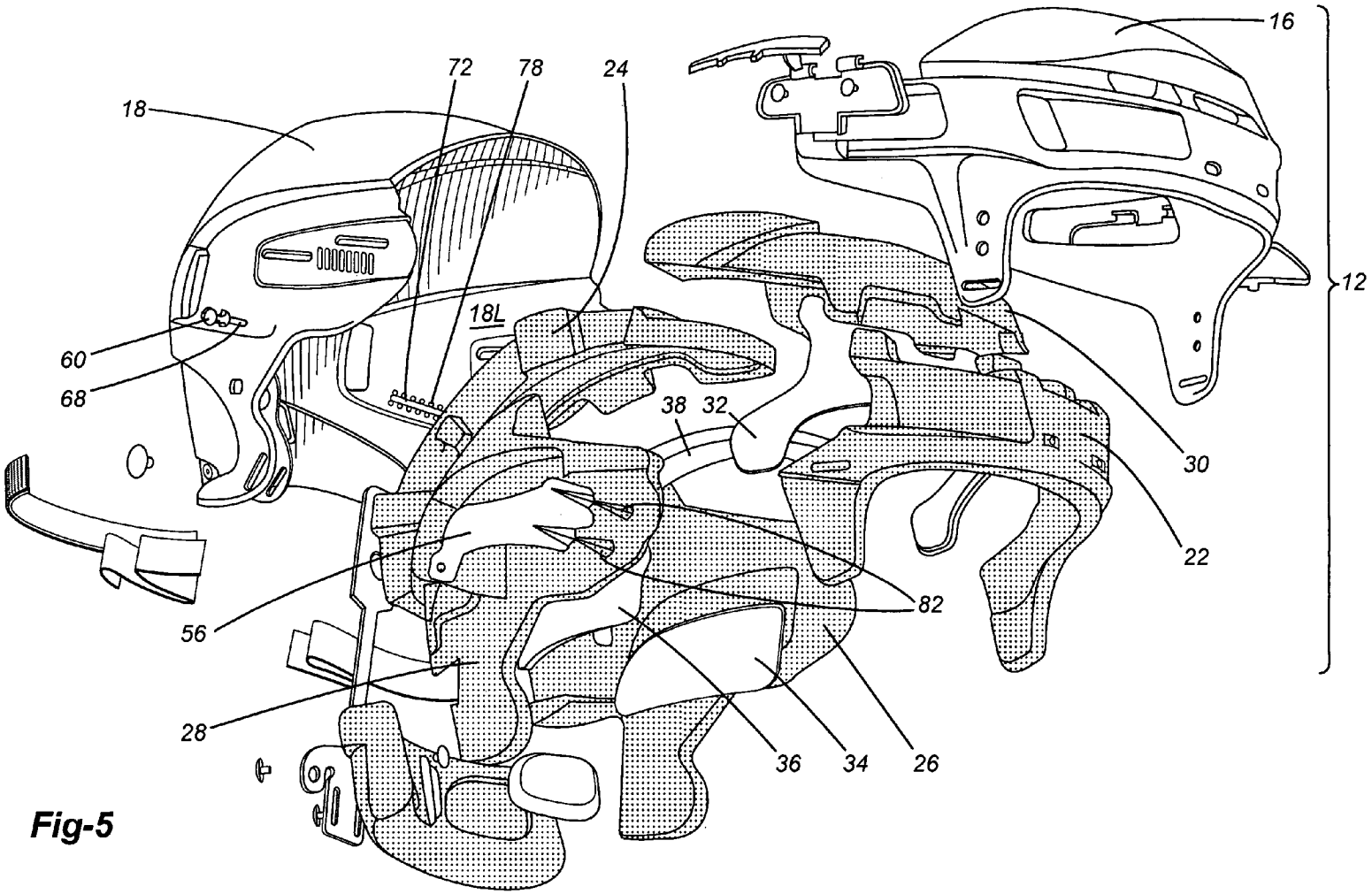
FIG. 5 is a front exploded perspective view of the hockey helmet of FIG. 3.
Figure 6:
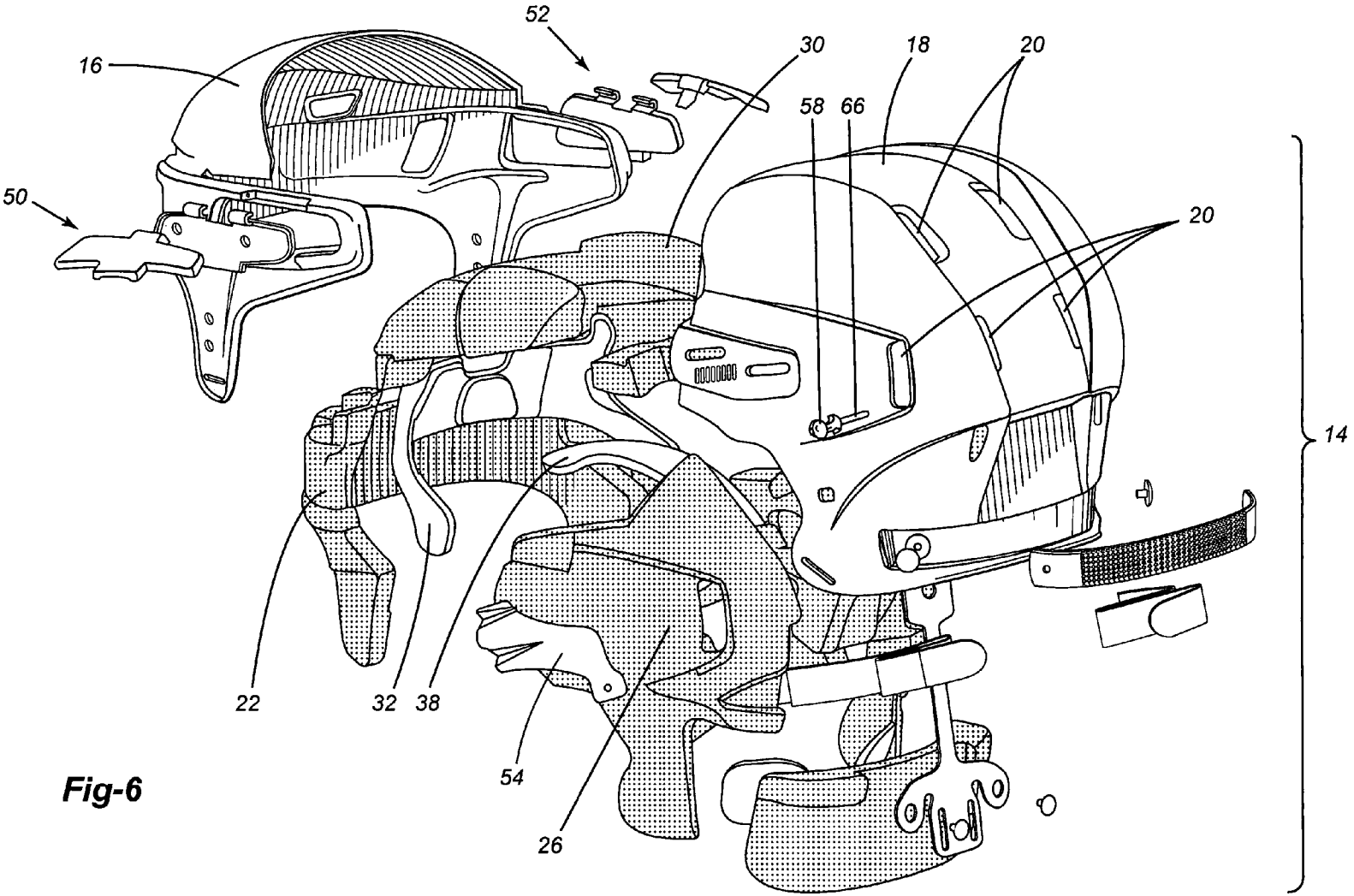
FIG. 6 a rear exploded perspective view of the hockey helmet of FIG. 3.
Figure 7:
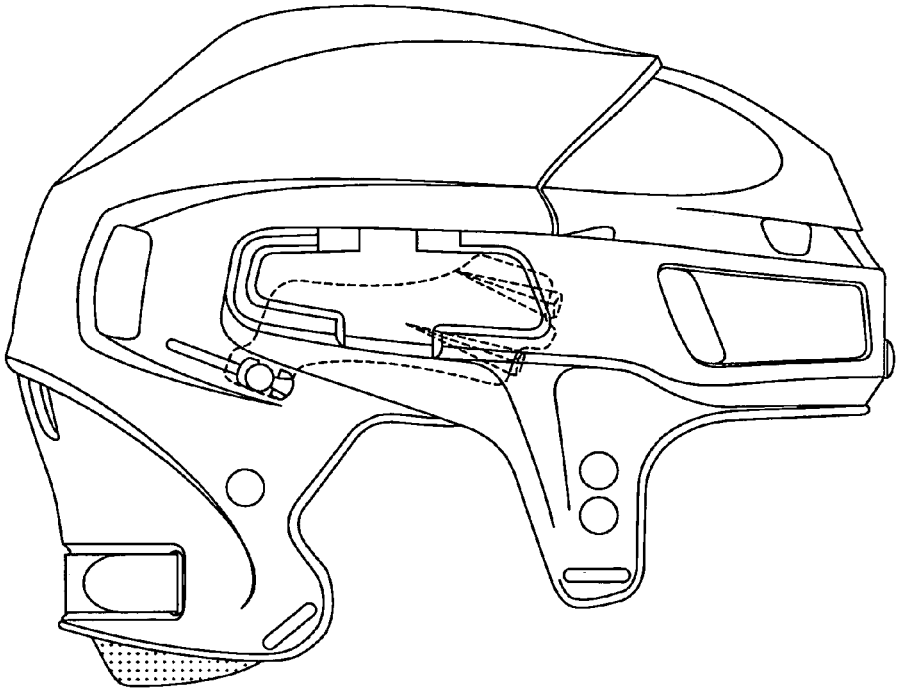
FIG. 7 is a right side elevational view of the hockey helmet of FIG. 3 with a right wedging member illustrated in dotted lines.
Figure 8:
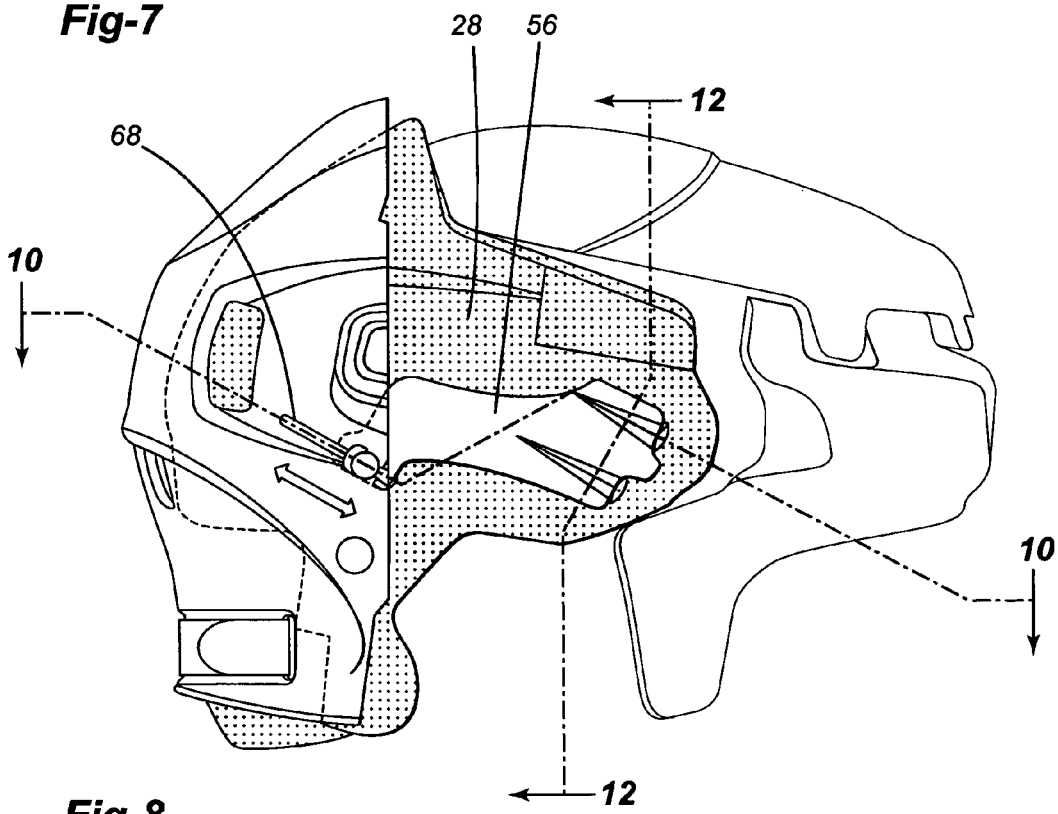
FIG. 8 is a right side elevational view of the hockey helmet of FIG. 3 with a portion of the outer shell cut-away to expose right wedging member and the right side inner pad.

FIGS. 1 and 2 illustrate a head of a wearer. The head comprises a crown region CR, left and right side regions LS, RS, a back region BR and an occipital region OC. The crown region CR has a front part that substantially corresponds to the forehead and a top part that substantially corresponds to the front top part of the head. In fact, the crown region CR generally corresponds to the frontal bone region of the head. The left and right side regions LS, RS are approximately located above the ears of the wearer. Occipital region OC substantially corresponds to the region around and under the external occipital protuberance of the head.

Figure 9:
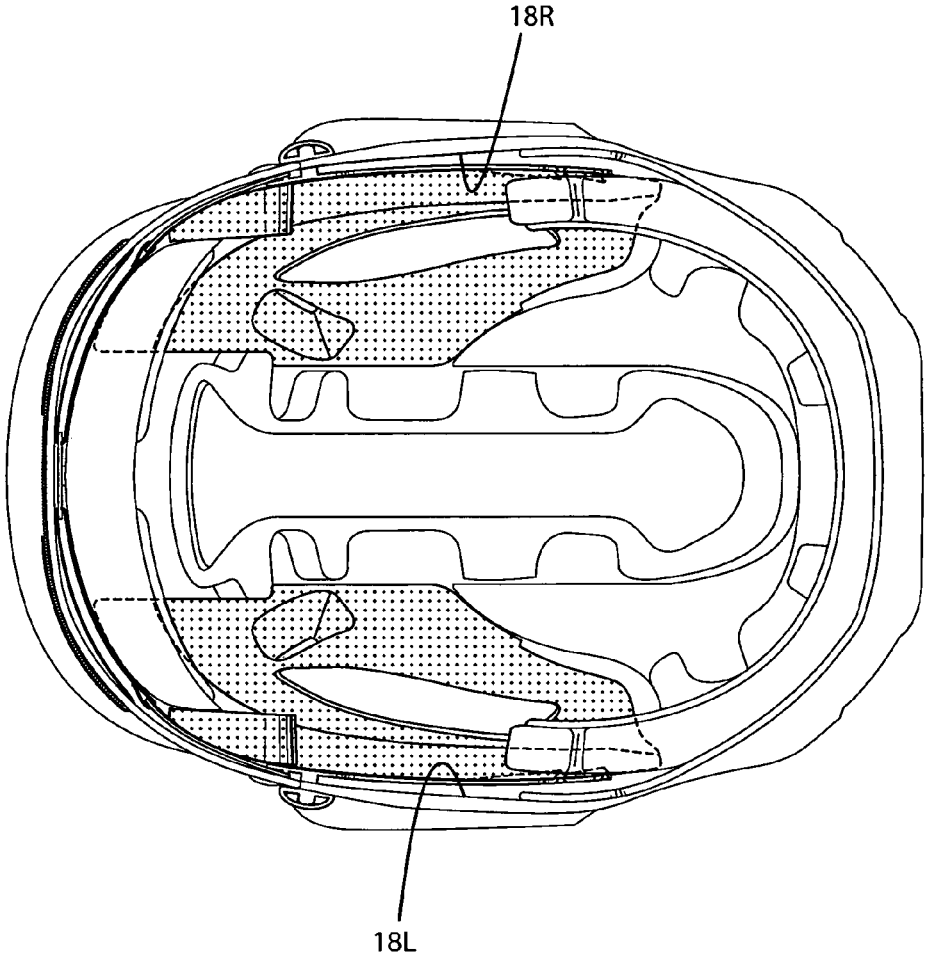
FIG. 9 is a bottom view of the hockey helmet of FIG. 3.

Referring to FIGS. 3 to 6, the hockey helmet 10 comprises a front portion 12 and a rear portion 14 interconnected together. Front and rear portions 12, 14 comprise respective front shell 16 and rear shell 18. The rear shell 18 comprises left and right side inner surfaces 18L, 18R (see FIGS. 5 and 9). It is understood that the helmet 10 may comprise a one-piece shell instead of a two piece shell. The front shell 16 and rear shell 18 may be made of a relatively rigid material, such as NYLON, polycarbonate materials, thermoplastics, or thermosetting resins or any other suitable material. The front and rear shells 16, 18 comprises a plurality of ventilation apertures 20 that provide the added comfort of allowing air to circulate around the head of the wearer.

The front shell 16 overlays front inner pad 22 and top inner pad 30 while the rear shell overlays rear central inner pad 24 and left and right side inner pads 26, 28. The left and right side inner pads 26, 28 at least partially cover the left and right side inner surfaces 18L, 18R of the rear shell 18. The front inner pad 22 faces the front part of the crown region CR while the top inner pad 30 faces the top part of the crown region CR. The central rear inner pad 24 faces the back region BR while the left and right side inner pads 26, 28 face the respective left and right side regions LS, RS. The inner pads 22, 24, 26, 28 may be made of shock absorbing materials such as expanded polypropylene (EPP) or expanded polyethylene (EPE). Other materials can also be used without departing from the spirit of the invention.

The front inner pad 22 and top inner pad 30 have three-dimensional configurations that match the three-dimensional configurations of the front shell 16 and are attached to the inner surfaces of the front shell 16 by any suitable means such glue, stitches, tacks, staples or rivets. Similarly, rear central inner pad 24 and left and right side inner pads 26, 28 have three-dimensional configurations that match the three-dimensional configurations of the rear shells 18 and are attached to the inner surfaces of the rear shells 18 by any suitable means, such as glue, stitches, tacks, staples or rivets.

The helmet 10 may also comprise a front comfort liner 32 affixed on the inner surface of the front inner pad 22, a top comfort liner 38 affixed on the inner surface of the top inner pad 30 and left and right side comfort liners 34, 36 affixed on the inner surface of the respective left and right side inner pads 26, 28. The comfort liners 32, 34, 36 and 38 may be made of soft materials such as polyvinyl chloride (PVC). Other materials can also be used without departing from the spirit of the invention. The comfort liners 32, 34, 36 and 38 may be affixed on the inner surface of the respective inner pads 22, 26, 28 and 30 by any suitable means, such as glue, stitches, tacks, staples or rivets.

The hockey helmet 10 may comprise left and right ear loops and a chin strap adapted to be attached to ear loops so that when it is secured beneath the chin of the wearer, the helmet 10 is maintained onto the head of the wearer. If desired, the helmet 10 may be provided with left and right ear covers for protecting the ears of the wearer.

The front and rear portions 12, 14 (front and rear shells 16, 18 more particularly) can move one with relation to the other so as to adjust the size of the head receiving cavity of the helmet 10. Left and right locking mechanisms 50, 52 retain the front and rear portions 12, 14 in the position selected by the wearer. Any suitable type of locking mechanisms such as the one described in U.S. Pat. No. 5,956,776 of Bauer Nike Hockey Inc. issued on Sep. 28, 1999 can be used without departing from the spirit of the invention.

In operation, a wearer who puts on the helmet 10 and realizes that it is too large or too small, does not need to remove the helmet 10 to adjust it. The wearer must simply release the locking mechanism 50, 52 expand or contract the size of the helmet 10 by displacing the front and the rear portion 12, 14 in relation to each other in the appropriate direction.

Alternatively, helmet 10 may comprise a non-adjustable one-piece shell covering a one-piece inner pad and a one-piece comfort liner. In another possible variant, the helmet 10 may comprise separate front and rear portions 12, 14 that are connected to one another in any suitable way but not adjustable one relative to the other.

As shown in FIGS. 5 to 12, the helmet 10 also comprises a left wedging member 54 located between the left side inner pad 26 and the left inner side surface 18L of the rear shell 18 and a right wedging member 56 located between the right side inner pad 28 and the right side inner surface 18R of the rear shell 18.

Figure 10:
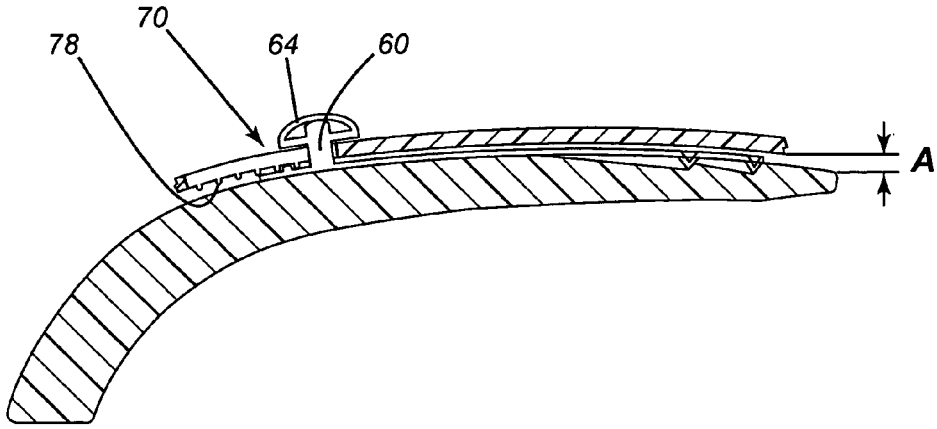
FIG. 10 is an enlarged cross-sectional view taken along lines 10 and showing the right wedging member in a first position.
Figure 11:
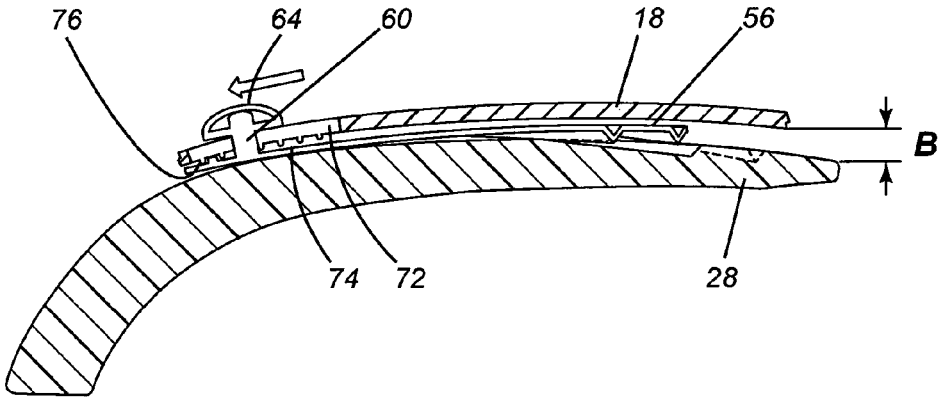
FIG. 11 is an enlarged cross-sectional view showing the right wedging member in a second position.

The left and right wedging members 54, 56 are movable between a first position (see FIG. 10) and a second position (see FIG. 11). In the first position, the left and right side inner pads 26, 28 apply a first pressure upon the left and right side regions LS, RS of the head. As shown in FIG. 10, in this first position, the left and right side inner pads 26, 28 are located at a distance A from the respective left and right side inner surfaces 18L, 18R. In the second position, the left and right side inner pads 26, 28 apply a second pressure upon the left and right side regions LS, RS of the head. As shown in FIG. 11, in this second position, the left and right side inner pads 26, 28 are located at a distance B from the respective left and right side inner surfaces 18L, 18R, the distance B being greater than the distance A. Hence, because the left and right side inner pads 26, 28 are closer to the respective left and right side regions LS, RS of the head in the second position, the second pressure applied by them on these respective left and right side regions LS, RS is greater than the first pressure.

The left and right wedging members 26, 28 may have a variable thickness. For example, the wedging member may be a panel having a portion with a thickness that increases from a first section to a second section. Because of this increase of thickness, the left and right wedging members 26, 28 exert on the respective left and right side inner pads 26, 28 an increasing pressure when they are displaced from the first position to the second position.

FIGS. 5–6 and 11–12 show another example wherein each of the left and right wedging members 54, 56 comprises at least one V-shaped projection 80 with a height that increases from a first section to a second section and wherein each of the left and right side inner pads 26, 28 comprises a V-shaped groove 82 with a depth that increases from a first section to a second section, the V-shaped projection 80 registering within the V-shaped groove 82 when the left and right wedging member 54, 56 move between the first and second positions. Due to the geometry of the projections 80 and grooves 82, the left and right wedging members 26, 28 exert on the respective left and right side inner pads 26, 28 an increasing pressure when they are displaced from the first position (see FIG. 10) to the second position (see FIG. 11). As seen in FIG. 10, the V-shaped projections 80 are almost entirely received within the V-shaped grooves 82 when the left and right wedging members 54, 56 are in the first position.

The left and right wedging members 54, 56 also comprise respective left and right mechanical actuation devices 58, 60 projecting thereof and having respective left and right knobs 62, 64. The rear shell 18 comprises left and right openings 66, 68 through which extend the respective left and right mechanical actuation devices 58, 60 such that the left and right knobs 62, 64 are accessible to the wearer on the outside of the helmet for moving the left and right wedging members 54, 56 between the first and second positions. Each knob is independently operable by the wearer.

Figure 12:
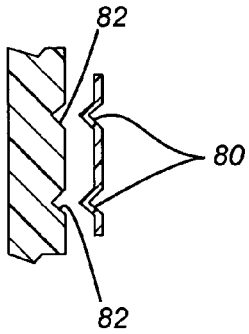
FIG. 12 is a partial enlarged cross-sectional view taken along lines 12—12.

Referring to FIGS. 10 to 12, the right wedging member 56 comprises a locking mechanism 70 for maintaining it in either one of the first and second positions. It is understood that the left wedging member 54 comprises the same locking mechanism and the following description also depicts the locking mechanism for the left wedging member 54. The locking mechanism 70 comprises an overlapping portion 72 provided on the right side inner surface 18R of the rear shell 18 and an overlapping portion 74 provided on the outer surface of the right wedging member 56. The overlapping portions 72, 74 interlock together for maintaining in place the right wedging member 56 i.e. for preventing unwanted operation of the mechanical actuation device. In the embodiment illustrated in FIGS. 10 to 12, the overlapping portion 74 of the right wedging member 56 comprises at least one tooth 76 and the overlapping portion 76 of the right side inner surface 18R comprises a toothed section 78, the tooth 76 and the toothed section 78 allowing movement of the right wedging member 56 relative to the right side inner surface 18R of the rear shell 18 when the right knob 64 is slidingly displaced by the wearer while allowing mechanical engagement for maintaining in place the right wedging member 56.

In use, the wearer may put the helmet 10 when the left and right wedging members 54, 56 are in the first position (see for example FIG. 10 illustrating the right wedging member 56 in the first position). If the wearer realizes that the fitting is not adequate, he/she then reaches the left and right knobs 62, 64 and displaces rearwardly the knobs 62, 64 in order to move the left and right wedging members 54, 56 towards the second position wherein the left and right side inner pads 26, 28 will apply a greater pressure upon the respective left and right side LS, RS of the head (see FIG. 11). Note that the wearer does not necessarily remove the helmet during this adjustment.

When the wearer obtains the adequate fitting, he/she then release the knobs 62, 64 and the left and right wedging members 54, 56 remains in the selected positions wherein the left and right side inner pads 26, 28 apply the appropriate pressure. Indeed, as indicated above, the tooth 76 and the toothed section 78 interlock for maintaining in place the right and left wedging member 54, 56. It is understood that the locking mechanism 70 may comprise a biasing means (e.g. a spring) for pressing together the overlapping portions 72, 74 when the wearer does not displace the knobs 62, 64.

If the amount of pressure is too high, the wearer can simply reaches again the left and right knobs 62, 64 and displaces forwardly the knobs 62, 64 in order to move the left and right wedging members 54, 56 towards the first position wherein the left and right side inner pads 26, 28 will apply less pressure upon the respective left and right side LS, RS of the head.

In describing the embodiments, specific terminology is resorted to for the sake of clarity but the invention is not intended to be limited to the specific terms so selected, and it is understood that each specific term comprises all equivalents. The above description of the embodiments should not be interpreted in a limiting manner since other variations, modifications and refinements are possible within the spirit and scope of the present invention. The scope of the invention is defined in the appended claims and their equivalents.

What is claimed is:

1. A hockey helmet for receiving a head of a wearer, the head having a crown region, left and right side regions, a back region and an occipital region, said helmet comprising:
   (a) a shell comprising left and right side inner surfaces;
   (b) left and right side inner pads at least partially covering said left and right side inner surfaces of said shell, said left and right side inner pads facing the respective left and right side regions of the head; and
   (c) a wedging member located between one of said left and right side inner pads and one of said respective left and right side inner surfaces, said wedging member being movable between first and second positions, wherein, in said first position, one of said left and right side inner pads applies a first pressure upon the respective left and right side regions of the head, and in said second position, one of said left and right side inner pads applies a second pressure upon one of the respective left and right side regions of the head, said second pressure being greater than said first pressure.

2. A hockey helmet as defined in claim 1, wherein said wedging member is a left wedging member located between said left side inner pad and said left inner side surface of said shell, said helmet further comprising a right wedging member located between said right side inner pad and said right side inner surface of said shell, said left and right wedging members being independently movable between first and second positions to allow independent adjustment of the pressure applied on the head by each said right side inner pad and said left side inner pad.

3. A hockey helmet as defined in claim 2, wherein said left and right wedging members comprise respective left and right mechanical actuation devices that are accessible to the wearer for moving said left and right wedging members between said first and second positions.

4. A hockey helmet as defined in claim 3, wherein said shell comprises left and right openings through which extend said left and right mechanical actuation devices, respectively.

5. A hockey helmet as defined in claim 4, wherein said left and right mechanical actuation devices project from said left and right wedging members respectively, and comprise respective left and right knobs that are accessible to the wearer such that the wearer can operate said left and right mechanical actuation devices.

6. A hockey helmet as defined in claim 5, wherein each of said left and right wedging members comprises a locking mechanism, said locking mechanism preventing said wedging member from moving unintentionally.

7. A hockey helmet as defined in claim 6, wherein said locking mechanism comprises a pair of overlapping portions capable to interlock with one another to prevent said wedging member from moving unintentionally.

8. A hockey helmet as defined in claim 7, wherein said overlapping portions comprise toothed sections allowing movement of said left and right wedging members relative to the respective left and right side inner surface when said respective left and right knobs are displaced by the wearer.

9. A hockey helmet as defined in claim 8 wherein each of said left and right wedging members comprises a panel having a variable thickness.

10. A hockey helmet as defined in claim 8 wherein each of said left and right wedging members comprises a V-shaped projection with a variable height.

11. A hockey helmet as defined in claim 10, wherein each of said left and right side inner pads comprises a V-shaped groove having a variable depth.

12. A hockey helmet as defined in claim 11, wherein said V-shaped projection registers with said V-shaped groove.

13. A hockey helmet as defined in claim 12, wherein said left and right side inner pads are made of expanded polypropylene (EPP) or expanded polyethylene (EPE).

14. A hockey helmet as defined in claim 13, wherein said left and right side inner pads comprise respective left and right comfort liners affixed on an inner surface of said left and right side inner pads.

15. A hockey helmet as defined in claim 14, wherein said left and right comfort liners are made of polyvinyl chloride (PVC).

16. A hockey helmet as defined in claim 15, wherein said shell comprises a front shell and a rear shell.

17. A hockey helmet as defined in claim 16, further comprising a front inner pad and a top inner pad affixed on front and top inner surfaces of said front shell respectively, said front and top inner pad facing the crown region of the head.

18. A hockey helmet as defined in claim 17, further comprising a rear central inner pad and an occipital inner pad affixed on a rear inner surface of said rear shell, said rear central and occipital inner pads facing the respective back and occipital regions of the head.

19. A hockey helmet as defined in claim 18, further comprising a front comfort liner affixed on an inner surface of said front inner pad and a top comfort liner affixed on an inner surface of said top inner pad.

20. A hockey helmet as defined in claim 16, wherein said front shell is movable relative to said rear shell for allowing size adjustment of said helmet.

21. A hockey helmet for receiving a head of a wearer, the head having a crown region, left and right side regions, a back region and an occipital region, said helmet comprising:

(a) a shell comprising left and right side inner surfaces;

(b) left and right side inner pads at least partially covering said left and right side inner surfaces of said shell, said left and right side inner pads facing the respective left and right side regions of the head; and (c) a wedging member located between one of said left and right side inner pads and said respective left and right side inner surfaces, said wedging member being selectively movable to vary the distance between the one of said left and right side inner pads and the respective left and right side inner surfaces, to adjust a fit of said helmet on the head of the wearer.

22. A hockey helmet as defined in claim 21, wherein said wedging member is a left wedging member located between said left side inner pad and said left inner side surface, said helmet further comprising a right wedging member located between said right side inner pad and said right side inner surface, said left and right wedging members being independently movable to adjust a fit of said helmet on the head of the wearer.

23. A hockey helmet as defined in claim 22, wherein said left and right wedging members comprise respective left and right mechanical actuation devices that are accessible to the wearer for moving said left and right wedging members.

24. A hockey helmet as defined in claim 23, wherein said left and right mechanical actuation devices comprise respective left and right knobs that are accessible to the wearer such that the wearer can operate said left and right mechanical actuation devices.

25. A hockey helmet as defined in claim 24, wherein each of said left and right wedging members comprises a locking mechanism, said locking mechanism preventing said wedging member from moving unintentionally.

* * * * *